United States Patent [19]

Palumbo et al.

[11] 4,022,668

[45] May 10, 1977

[54] PROCESS FOR THE PRODUCTION OF FORMED COKE

[75] Inventors: Luigi Palumbo; Angelo Colletta, both of Rome, Italy

[73] Assignee: Centro Sperimentale Metallurgico S.p.A., Rome, Italy

[22] Filed: July 3, 1975

[21] Appl. No.: 593,052

[30] Foreign Application Priority Data

July 3, 1974 Italy ..... 51893-A/74

[52] U.S. Cl. ..... 201/5; 201/7; 201/28; 201/31; 201/36; 201/44

[51] Int. Cl.[2] ..... B10B 47/24; B10B 49/02; B10B 53/04; B10B 57/02

[58] Field of Search ..... 201/5, 7, 8, 14, 28, 201/29, 31, 36, 44; 48/202, 206, 210

[56] References Cited

UNITED STATES PATENTS

| | | | |
|---|---|---|---|
| 2,650,190 | 8/1953 | Steinschlaeger | 201/29 |
| 2,955,077 | 10/1960 | Welinsky | 201/31 X |
| 3,140,241 | 7/1964 | Work et al. | 201/5 |
| 3,184,293 | 5/1965 | Work et al. | 201/5 X |
| 3,444,046 | 5/1969 | Harlow | 201/8 X |

*Primary Examiner*—Morris O. Wolk
*Assistant Examiner*—Michael S. Marcus
*Attorney, Agent, or Firm*—Young & Thompson

[57] ABSTRACT

In the production of formed coke, the temperatures and times of the oxidation and carbonization phases can be reduced if 5 to 12% by volume of oxygen is included in the fluidizing gas in a fluidized bed reactor in which the carbonization phase is conducted.

2 Claims, 1 Drawing Figure

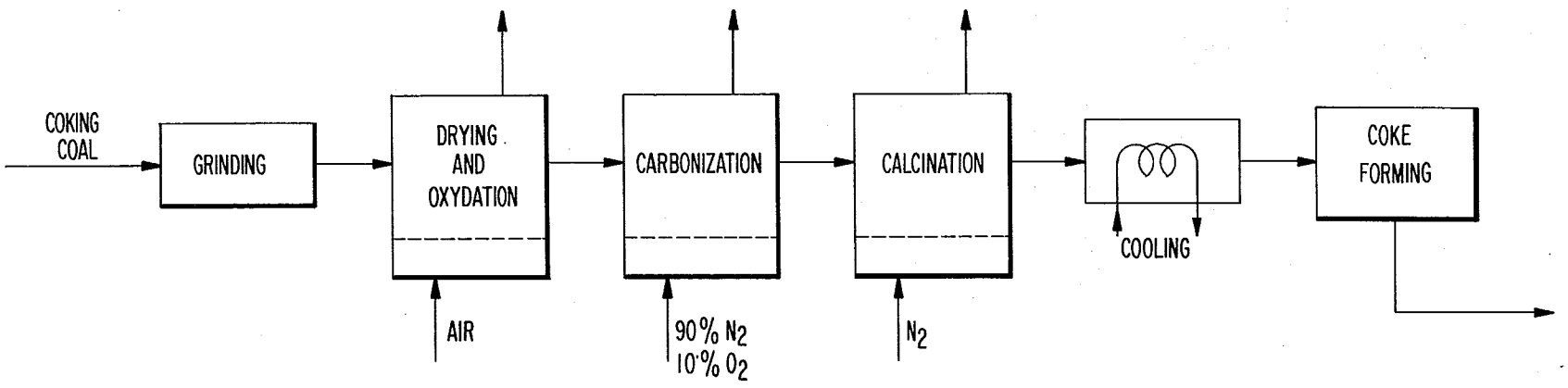
COKING COAL
GRINDING
DRYING AND OXYDATION
AIR
CARBONIZATION
90% N2
10% O2
CALCINATION
N2
COOLING
COKE FORMING

PROCESS FOR THE PRODUCTION OF FORMED COKE

The present invention relates to the production of formed coke, more particularly by a process comprising the grinding of coal, the heating of the coal in the presence of oxygen during an oxidation phase, and the further heating of the coal in a carbonization phase, followed by a calcination phase, with cooling, briquetting, hardening and baking of the formed coke.

Known processes of forming coke involve the following operations and the following sequence:

1. The grinding of the coking coal, e.g. up to a particle size of 1 millimeter.

2. Heating of the pulverulent coal in a fluidized bed, in the presence of 5 to 21% by volume of oxygen, balance preferably essentially nitrogen, at a temperature between 300 and 430° C. for a period of time from 20 to 180 minutes, so as to destroy any possible cokifying and agglomerating tendency of the coal and to create conditions for the formation of peroxides which favor the subsequent polymerization of the product. This is the so called oxidation phase.

3. Heating of the pulverulent coal in a fluidized bed reator, in a stream of nitrogen, at temperatures around 500° C. to eliminate some contituents of the coal which are given off as vapors and condense as tar that is subsequently used as the binder in the formation of briquettes. This is the so-called carbonization phase.

4. A so-called calcination or semi-coking phase, in which the material is heated to a temperature around 900° C. to eliminate the less volatile fractions.

5. Cooling of the semi-coke thus obtained, to a temperature of 20°–100° C. in order to prevent flaming of the semi-coke upon contact with the air.

6. Briquetting the coke at a pressure of 300–1000 kg/cm$^2$, at a temperature of 30°–100° C.; hardening the thus formed coke at a temperature of 100°–400° C. for 20–120 minutes; and baking the formed coke at a temperature of 600°–1000° C. for 5–30 minutes.

The above known processes, however, suffer from the following disadvantages:

1. If coals with a substantial tendency to agglomerate are used in the process, then a plurality of oxidation reactors are needed to enable the oxidation phase to be carried to completion. Indeed, in this case, lengthy treatment is needed which is incompatible with a continuous process performed in a single reactor. The need to resort to stepwise oxidation in separate reactors, each having a treatment time compatible with that of the other phases of the process, greatly adds to the cost of the operation.

2. There is an undesirably high energy consumption during the course of the process, not only because of the highertreatment temperatures involved in the oxidation and carbonization phases, but also because of the inevitable heat losses due to the large differences between the temperature of the reactors and the ambient temperature.

Accordingly, it is an object of the present invention to provide methods for the production of formed coke, in which the treatment temperatures and/or treatment times in the oxidation and carbonization phases are substantially reduced as compared to those of the prior art.

It is also an object of the present invention to provide processes for the production of formed coke, which consume substantially less energy and that are characterized by reduced heat losses, as compared to the prior art.

Finally, it is an object of the present invention to provide processes for the production of formed coke, which will be relatively simple and inexpensive to practice, and reliable as to the production of formed coke of uniformly high quality.

Briefly, the objects of the present invention are achieved, by introducing oxygen into the carbonization phase, in which the coke is in the plastic state. Preferably, the oxygen is introduced in an amount of 5 to 12% by volume of the gas that is used to suspend the pulverulent coal in a fluidized bed in the carbonization phase.

As a result of the practice of the present invention, it is possible to reduce the treatment times and/or temperatures in both the oxidation and the carbonization phases.

The accompanying drawing is a greatly simplified schematic flow diagram of a continuous process according to the present invention.

In greater detail, the steps outlined above, according to the present invention, comprise the following:

1. Grinding: same as in the prior art.

2. Oxidation phase: 100°–280° C. for 10 to 30 minutes; otherwise same as in prior art.

3. Carbonization phase: the fluidizing gas contains 5 to 12% by volume oxygen, balance preferably essentially nitrogen; the temperature is 300°–600° C., preferably 300°–450° C.; and the time is 10 to 30 minutes. Apart from this, the prior art conditions can be applied.

4. Calcination or semi-coking phase: same as in the prior art.

5. Cooling: same as in the prior art.

6. Briquetting, hardening and baking: same as in the prior art.

In order to enable those skilled in the art to practice the invention, the following example is given, purely for illustrative purposes and in a non-limiting sense.

EXAMPLE

| | |
|---|---|
| A coal having the following characteristics: | |
| Percentage composition, by weight | |
| Volatile matter | 29.8 |
| Ash | 5.36 |
| Total sulphur | 0.69 |
| Hydrogen | 5.22 |
| Phosphorus | 0.024 |
| Gross heat value (in kcal/kg) | 7,996 |
| Free swelling index | 8 ½ |

is subjected to the following steps, in the order outlined above:

1. Grinding to a particle size of up to 1 millimeter.

2. Drying and oxidation at 260° C. for 20 minutes in a stream of air as the fluidizing agent.

3. Carbonization at 420° C. for 20 minutes in a fluidizing mixture consisting of 90% nitrogen and 10% oxygen.

4. Calcination or semi-coking at 900° C. for 25 minutes in a stream of nitrogen.

5. Cooling to 60° C.

6. Briquetting at 700 kg/cm$^2$ at a temperature of 70° C; hardening at a temperature of 300° C. for 80 minutes; and baking at a temperature of 800° C. for 20 minutes, followed by cooling to ambient temperature.

Formed coke is obtained comparable in quality to that produced by the prior art method in which, instead of the exemplified conditions given immediately above, step 2, the drying and oxidation, was conducted at 380° C. for 90 minutes and step 3, the carbonization, was conducted at 550° C. for 20 minutes, in oxygen-free nitrogen.

From a consideration of the foregoing disclosure, therefore, it will be evident that all of the initially recited objects of the present invention have been achieved.

Although the present invention has been described and illustrated in connection with preferred embodiments, it is to be understood that modifications and variations may be resorted to without departing from the spirit of the invention as those skilled in this art will readily understand. Such modifications and variations are considered to be within the purview and scope of the present invention as defined by the appended claims.

What is claimed is:

1. In a process for the production of formed coke, comprising grinding coal, heating the ground coal in the presence of oxygen in a drying and oxidation phase, heating the ground coal at a higher temperature in a carbonization phase, heating the coal at a still higher temperature in a calcination phase to obtain semi-coke, cooling the obtained semi-coke, and thereafter briquetting, hardening and baking the semi-coke to produce formed coke; the improvement comprising conducting said drying and oxidation phase in a fluidized bed at a temperature of 100° to 280° C. for a time of 10 to 30 minutes, and conducting said carbonization phase in a fluidized bed at a temperature of 300° to 600° C. for a time of 10 to 30 minutes, the gas fed to said fluidized bed of said carbonization phase consisting essentially of 90% by volume nitrogen and 10% by volume oxygen.

2. A process as claimed in claim 1, in which the temperature of said carbonization phase is 300° to 450° C.

* * * * *